US006460192B2

(12) United States Patent
Kindler

(10) Patent No.: US 6,460,192 B2
(45) Date of Patent: Oct. 8, 2002

(54) PUNCTURE-RESISTANT GLOVES

(75) Inventor: Bruce R. Kindler, West Linn, OR (US)

(73) Assignee: Warwick Mills, Inc., New Ipswich, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/843,104

(22) Filed: Apr. 25, 2001

(65) Prior Publication Data

US 2001/0049839 A1 Dec. 13, 2001

Related U.S. Application Data

(63) Continuation-in-part of application No. 09/621,639, filed on Jul. 21, 2000, which is a continuation of application No. 09/282,756, filed on Mar. 31, 1999, now Pat. No. 6,094,748, which is a continuation-in-part of application No. 09/234,625, filed on Jan. 21, 1999, now Pat. No. 6,052,829.

(51) Int. Cl.[7] ..... A41D 19/00

(52) U.S. Cl. ..... 2/167; 2/16; 2/161.6; 2/169

(58) Field of Search ..... 2/16, 20, 161.6, 2/167, 169, 161.7, 161.8, 163

(56) References Cited

U.S. PATENT DOCUMENTS

| | | | | |
|---|---|---|---|---|
| 3,961,377 A | | 6/1976 | Lars-Jos | |
| 4,042,977 A | | 8/1977 | Antonious | |
| 4,384,449 A | | 5/1983 | Byrnes, Sr. et al. | |
| 4,742,578 A | | 5/1988 | Seid | |
| 5,087,499 A | | 2/1992 | Sullivan | |
| 5,119,512 A | | 6/1992 | Dunbar et al. | |
| 5,224,363 A | | 7/1993 | Sutton | |
| 5,231,700 A | | 8/1993 | Cutshall | |
| 5,423,090 A | | 6/1995 | Gimbel | |
| 5,564,127 A | | 10/1996 | Manne | |
| 5,565,264 A | | 10/1996 | Howland | |
| 5,568,657 A | | 10/1996 | Cordova et al. | |
| 5,628,172 A | * | 5/1997 | Kolmes et al. | 57/210 |
| 5,685,014 A | | 11/1997 | Dapsalmon | |
| 5,799,333 A | * | 9/1998 | McGarry et al. | 2/161.6 |
| 5,822,791 A | | 10/1998 | Baris | |
| 5,911,313 A | * | 6/1999 | Gold | 2/159 |
| 6,052,829 A | * | 4/2000 | Kindler | 2/167 |
| 6,094,748 A | * | 8/2000 | Kindler | 2/167 |

OTHER PUBLICATIONS

Complaint and Demand for Jury Trial; Civil Action No. C–00–337–B, United States District Court for the District of New Hampshire.

Amended Complaint and Demand for Jury Trial; Civil Action No. C–00–337–B.

Answer of Defendant Kinco International Inc. and Defendant Bruce R. Kindler to Amended Complaint; Civil Action No. C–00–337–B.

(List continued on next page.)

*Primary Examiner*—John J. Calvert
*Assistant Examiner*—Katherine Moran
(74) *Attorney, Agent, or Firm*—Vernon C. Maine; Scott J. Asmus; Maine & Asmus

(57) ABSTRACT

The present invention provides a puncture-resistant glove and a puncture-resistant glove liner, each suitable for protecting a hand comprising a palmar side and a dorsal side. In preferred embodiment, the glove or glove liner comprises a palmar portion designed to fit over the palmar side of the hand, the palmar portion being made of a puncture-resistant material. The glove or glove liner also comprises a dorsal portion designed to fit over at least part of the dorsal side of the hand, and optionally being made of a puncture-resistant material, the dorsal portion being sewn to the palmar portion along seams substantially located on a dorsal side of the glove.

57 Claims, 8 Drawing Sheets

OTHER PUBLICATIONS

First Amended Answer of Defendant Kinco International Inc. and Defendant Bruce R. Kindler to Amended Complaint and Counterclaim; Civil Action No. C–00–337–B.
Reply to Counterclaim of Defendant Bruce R. Kindler; Civil Action No. C–00–337–B.
Reply of Defendant Bruce R. Kindler to Counterclaim of Plaintiff (included in Plaintiff's Reply to Defendants' Counterclaim).
Copies of seven (7) photographs of glove alleged by Warwick to be a prior art glove; *undated*.

* cited by examiner

PUNCTURE-RESISTANT GLOVES

CROSS-REFERENCE TO RELATED APPLICATIONS

This application is a continuation-in-part of, and claims priority from, U.S. patent application Ser. No. 09/621,639 filed Jul. 21, 2000, which is a continuation of, U.S. patent application Ser. No. 09/282,756, filed Mar. 31, 1999, now U.S. Pat. No. 6,094,748, which is a continuation-in-part of U.S. patent application Ser. No. 09/234,625 filed Jan. 21, 1999, now U.S. Pat. No. 6,052,829.

FIELD OF THE INVENTION

The present invention provides puncture-resistant gloves and glove liners. Specifically, the gloves are useful for wearers facing a risk of needle puncture, especially when there is a risk or probability of contaminated needles.

BACKGROUND OF THE INVENTION

Gloves come in many varieties, each designed to protect a person's hand from some sort of hazard without overly impairing the person's manual dexterity. For example, insulated ski gloves protect a skier's hands from moisture and low temperatures while allowing the skier to grip ski poles. Latex gloves protect doctors and other health care providers from external contamination while allowing them to handle small, delicate surgical tools, and also prevent the patient from being contaminated by microorganisms on the hands of the health care provider. Leather gloves protect a person's hand from abrasion, thorns and heavy loading while allowing the person to grip and move heavy or rough-surfaced items. Finally, chain-mail gloves protect a person's hand from being cut by knives.

Gloves usually are a compromise between adequate protection and manual dexterity. A glove's design and the material from which it is built determine the glove's characteristics. Thus, a large glove built with heavy materials provides a lot of protection but impairs manual dexterity. Examples of this type of glove include ski gloves, which tend to be large and are made of several layers including a liner, and insulation layer, and an outer shell, and leather work gloves, which are large and made with thick, heavy leather to provide much protection. In contrast to a large and heavy glove, a small, tight-fitting glove made with thin, lightweight materials provides less physical protection but more manual dexterity. For example, surgeon's gloves are tight-fitting and made with thin, lightweight materials such as latex. The surgeon's glove allows much manual dexterity but acts only as a barrier against contaminated fluids and contaminated contact surfaces. The glove's thin construction does not permit it to provide much protection against such mechanical hazards as piercing or cutting with surgical instruments.

While existing gloves protect the hands from a number of environmental conditions, none effectively provide puncture resistance, especially from contaminated needles, without impairing manual dexterity; gloves that do provide puncture-resistance tend to be thick, heavy and awkward. There is thus a need for a lightweight and relatively thin puncture-resistant glove.

SUMMARY OF THE INVENTION

The present invention provides a puncture-resistant glove, and a puncture-resistant glove liner, for protecting a hand comprising a palmar side and a dorsal side. The glove comprises a palmar portion designed to fit over the palmar side of the hand, the palmar portion being made of puncture-resistant material. In preferred embodiments, the puncture-resistant material comprises a plurality of layers of a base fabric having a plurality of warp yarns densely interwoven with a plurality of fill yams, the base fabric having a warp crimp, a fill crimp and a cover between adjacent warp yarns at the fill crossing of at least 100%. The glove also comprises a dorsal portion designed to fit over at least part of the dorsal side of the hand, the dorsal portion being sewn to the palmar portion along seams.

DETAILED DESCRIPTION OF THE INVENTION

Described below are four embodiments of the present puncture-resistant glove, and two embodiments of the present puncture-resistant glove liner. The embodiments illustrate ways in which the present puncture-resistant glove and liner may be implemented. In the description that follows, like numerals represent like elements in all figures. For example, if the numeral 10 is used in one figure to refer to a specific element or step, the numeral 10 appearing in any other figure refers to the same element.

First Embodiment

Figure 1:
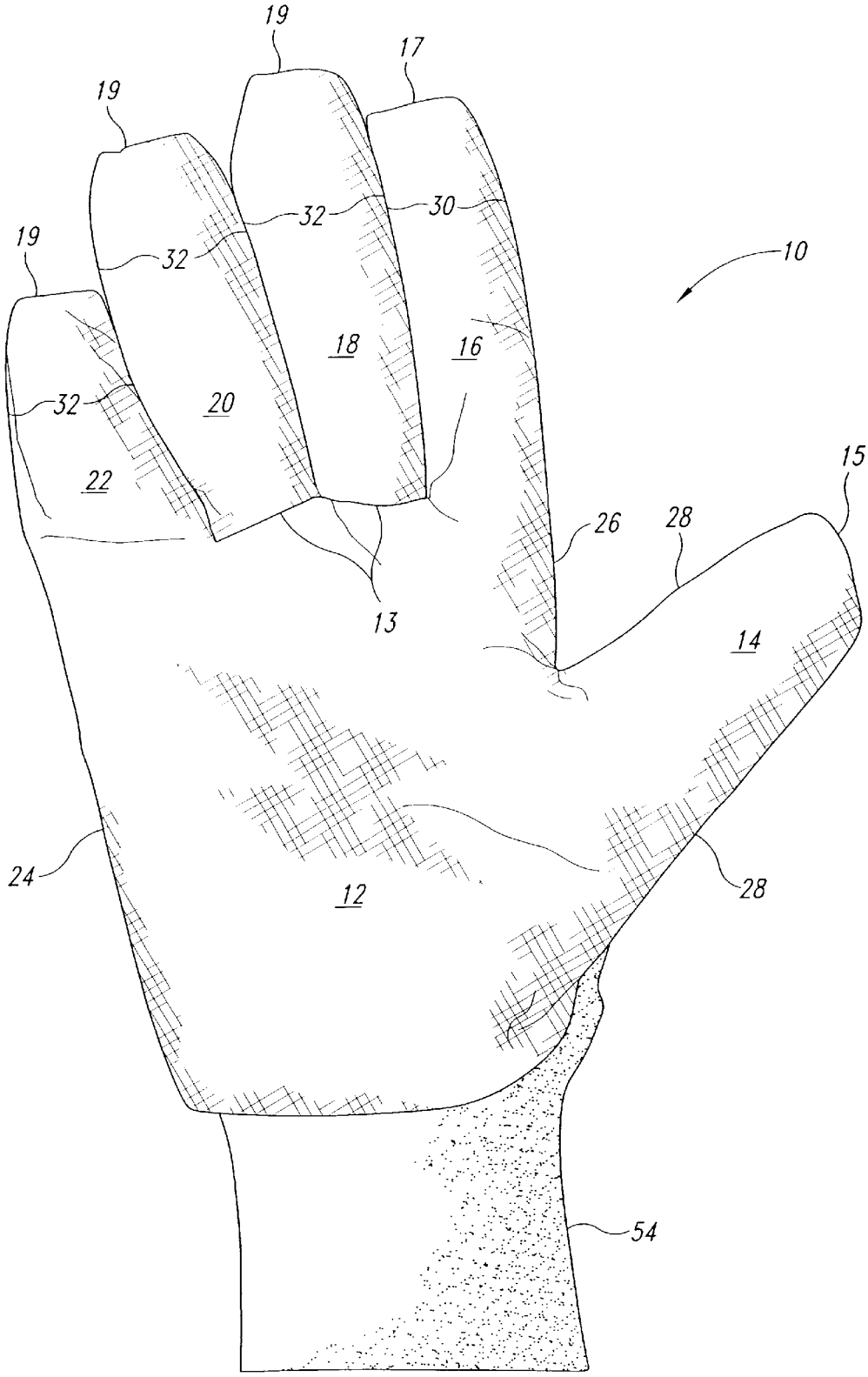
FIG. 1 is a plan view of a palmar side of a first embodiment of the inventive puncture-resistant glove showing the puncture-resistant material in a lighter shade, and the stretchable elastic material as a dark shade. The figure illustrates a right-hand glove.

FIG. 1 illustrates a palmar side 10 of a first embodiment of a puncture-resistant glove. The palmar portion covers the entire palmar side of a hand, and includes a palm 12, a thumb 14, an index finger 16, a middle finger 18, a ring finger 20, and a little finger 22. The middle finger 18 and ring finger 20 are connected to palm 12 along seam 13, while the thumb 14, index finger 16 and little finger 22 are integrally attached to the palm 12 with the same piece of puncture resistant material. The palmar portion of the glove offers additional protection to the hand by wrapping around the sides of the hand, fingers and finger tips to the dorsal side of the glove. Thus, the palmar portion wraps around the lateral side 24 and the contra-lateral side 26 of the hand, the sides 28 of the thumb, the sides 30 of the index finger, and the sides 32 of the middle finger 18, the ring finger 20 and the little finger 22. In addition, the palmar portion wraps around the tip 15 of the thumb, the tip 17 of the index finger, and the tips 19 of the middle, ring and little fingers.

By wrapping the palmar portion of the glove around the lateral side 24 and contra-lateral side 26 of the hand, and around the sides 28, 30 and 32 and tips 15, 17 and 19 of each finger, most seams on the glove are positioned on the dorsal side of the glove. Minimizing the number of seams on the palmar side of the glove increases the glove's puncture protection, because the seams are structural weak points where a sharp object could penetrate.

Puncture-resistant materials. The palmar portion of the glove is made of puncture resistant material. The dorsal portion of the glove is optionally made of puncture-resistant material. Art-recognized puncture resistant materials include, but are not limited to fibers comprised of polyolefin, polyvinyl alcohol, polyacrylonitrile, polyester, and polyamide materials (see U.S. Pat. No. 4,737,401 and U.S. Pat. No. 4,574,105, incorporated by reference herein in their entirety). Both continuous filament yarns (having high strength and high modulus) and staple (short fiber) yams can be used. Secured layers of puncture-resistant fabric offer additional protection.

In preferred embodiments of the present invention, puncture-resistant materials comprise a plurality of layers of a base fabric having a plurality of warp yams densely interwoven with a plurality of fill yams. The base fabric has characteristic warp and fill "crimps," and a "cover" of at least 100%, between adjacent warp yarns at the fill crossing. The "cover," is the overlap between adjacent warp yams as measured at the fill crossing. The cover is determined as the sums of each of the widths w of the yarns in a given fabric cross section, divided by the length 1 of the cross section. The cover of a normal fabric is approximately 115%, with a cover of 100% indicating essentially no overlap of warp yarns. By contrast, tightly woven dense fabric has relatively higher cover values (e.g., 130%). Overlap of warp yarns is important for penetration-resistance. The crimp in a given direction (warp or fill) is defined as the length of a given section of yarn along that direction when woven, divided by the length of the same yarn when freed from its woven state in the fabric section. In order for the fill yarns to be packed closely together, the warp yarns must follow an increasingly crimped serpentine path. The high warp crimp is necessary for forming a tight structure with minimally sized openings in the interstices. Typically puncture-resistant materials of the present invention have asymmetric crimp ratios, where the crimp of the warp yarn is greater than the crimp of the fill yarn. This results in tightly packed woven structures that exhibit high penetration resistance.

Preferably, the puncture-resistant portions of the gloves and glove liners (see below) of the present invention are made using the densely-woven puncture-resistant fabrics disclosed in U.S. Pat. No. 5,565,264, U.S. Pat. No. 5,837,623 and U.S. Pat. No. 5,976,996 (incorporated by reference herein in their entirety). A preferred puncture-resistant material is sold under the trademark TURTLESKIN by Warwick Mills, Inc., of New Ipswich, N.H. The puncture-resistant material is formed from a plurality of layered, densely woven fabrics, each formed by tightly weaving multi-filament yarns to obtain a warp yarn "density" or "cover" in excess of 100 percent at the center of the fill yam. Further, the fill yarn density or cover is preferably also in excess of 75 percent as measured between two warp ends. Fibers which have been found especially suitable for the warp and fill yarns are the para-aramids (e.g., Kevlar®); high density polyethylenes (e.g., Spectran®); and liquid crystal polymers (e.g., Vectran®).

The number of layers of basic fabric used in the puncture-resistant material depends on the hazards against which the wearer of the glove is to be protected. For example, protection against penetration by thin instruments such as awls or hypodermic needles is extremely difficult. Yet when the fabric and construction of the present puncture-resistant material, 20 layers of a 110×67 weave of density 200×400 denier resisted penetration forces up to 1.6 inch pounds as applied with an ice pick of 0.163 inch diameter. When 54 layers of basic fabric were stacked together, the resultant composite resisted penetration up to an applied awl force in excess of 400 inch pounds.

The dense construction of the fabric layers in the puncture-resistant fabric restricts in-plane motion. This requires increased out of plane extrusion for any significant penetration. The out of plane extrusion forces significantly accumulate over excessive layers to the extent that further penetration requires breakage of large numbers of high modulus, high breaking strength fibers before further penetration can be achieved. This not only limits penetration by thin, sharp instruments such as awls, picks, and hypodermic needles, but also increases protection against sharp-edged instruments, such as knives, which must first penetrate before they can cut.

Figure 2:
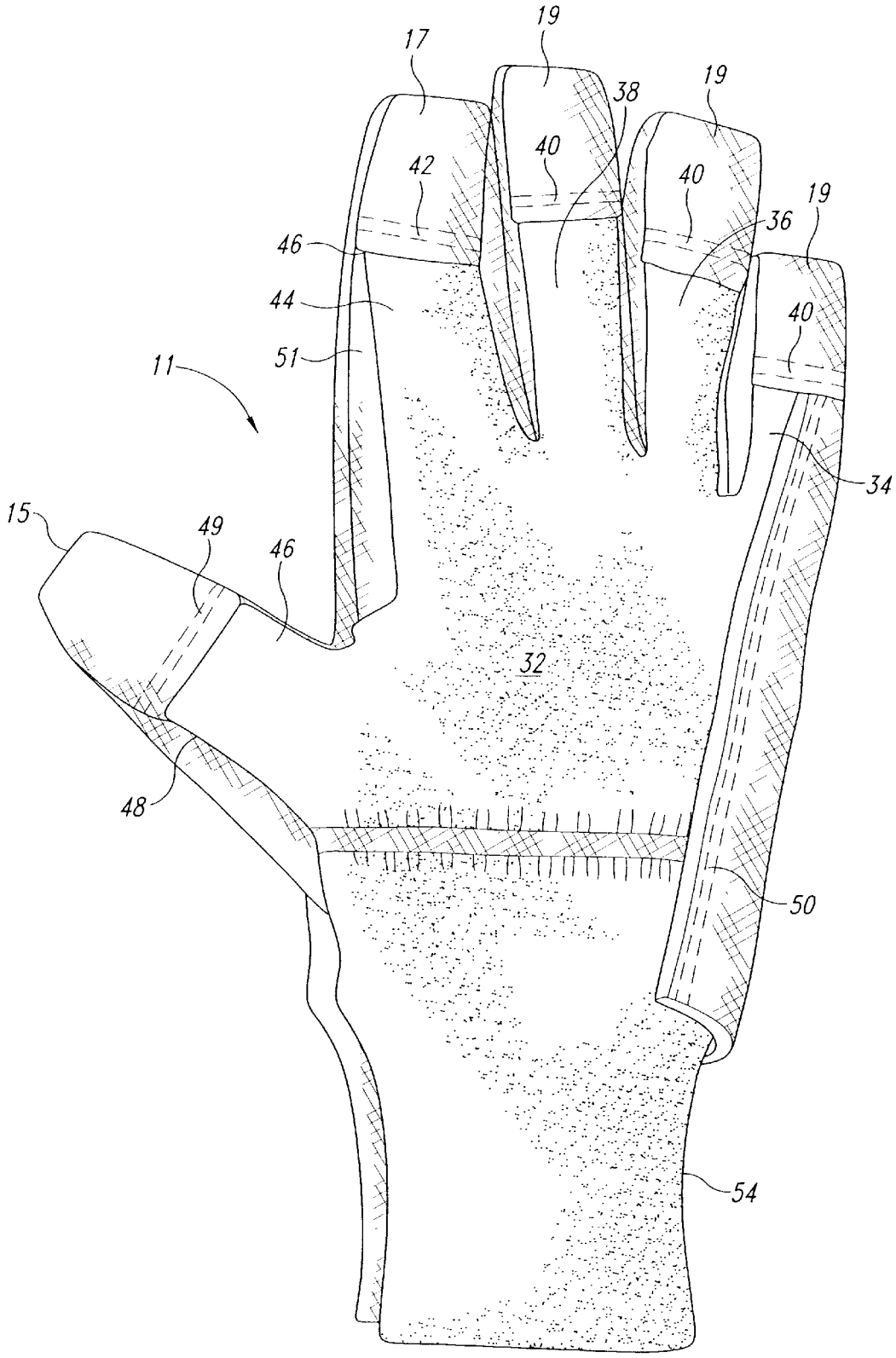
FIG. 2 is a plan view of a dorsal side of the first embodiment of the inventive puncture-resistant glove showing the seams and areas of puncture-resistant material (lighter shade) and stretchable elastic material (darker shade). The seams joining the puncture-resistant material to the stretchable material are shown. The figure illustrates a right-hand glove.

FIG. 2 illustrates the dorsal side 11 of the first embodiment of the puncture-resistant glove. The dorsal side 11 of the glove 10 consists primarily of a dorsal portion 32 that includes a little finger portion 34, a ring finger portion 36, a middle finger portion 38, an index finger portion 44 and a thumb portion 46. The dorsal portion is sewn to the palmar portion along finger tip seams 40, 42 and 49, thumb seam 48, lateral seam 50 and contra-lateral seam 51, all of which are positioned on the dorsal side of the glove. At finger tip seams 40, 42 and 49 the palmar portions wrapped around the fingertips 19, 17 and 15 are sewn to the little finger portion 34, the ring finger portion 36, the middle finger portion 38, the index finger portion 44 and the thumb portion 46. The palmar portion also wraps around the lateral and contra-lateral sides of the hand and is sewn to the dorsal portion 32 along the lateral seam 50 and the contra-lateral seam 51. The palmar portion wraps around the side of the thumb 14 and is sewn to the dorsal portion along the thumb seam 48.

Dorsal portion 32 is provided with additional features that improve the fit of the glove. For example, a shirred elastic band (not shown) can be sewn transversely into the dorsal portion 32 to provide a snug fit on the hand. In addition, an elastic knit wrist 54 is sewn to both the dorsal portion 32 and the palm 12, allowing the glove to fit properly on the wrist and hand of the user. The dorsal portion is preferably made using a one-way stretch material.

The puncture-resistant glove 10 is manufactured using tools known in the art. The first step is to make patterns for both the palmar and dorsal portions of the glove. The pattern for the palmar portion takes into account the wrapping of the palmar portion around the sides of the hand, the sides of each finger, and the tips of each finger. Next, the palmar and dorsal portions are cut from their respective materials, and the dorsal portion is prepared for sewing by inserting the shirred elastic (not shown) and sewing it to the dorsal portion 32 using a Zig Zag sewing machine.

Having patterned and cut the palmar and dorsal portions, the next step is to sew the glove together. Although the material used on the palmar portion is puncture-resistant, it can be sewn. Most of the sewing is done using a standard No. 18 needle, which is normally used for sewing heavy, thick leather products. The force exerted on the needle by a sewing machine is much greater than the force the glove would have to withstand under normal conditions. All the sewing is done using nylon thread.

The first sewing step is to sew the palmar portion together along seam 13 and to sew the palmar portion to the dorsal portion along seams 40, 44, and 48 using a specialized PIQUE sewing machine. The PIQUE sewing machine allows sewing in the very limited space along these seams. Next, the glove component are turned inside out and transferred to a standard sewing machine, where seams 42, 48 and 50 are sewn using a standard sewing machine. The glove is turned right-side-out again and the elastic wrist 54 is sewn onto the palm 12 and dorsal portions 32 using a normal overlock sewing machine. The glove is completed by transferring all components back to the PIQUE machine to sew the seam 50 on the lateral side 24 of the glove between the wrist and the little finger.

Second Embodiment

Figure 3:
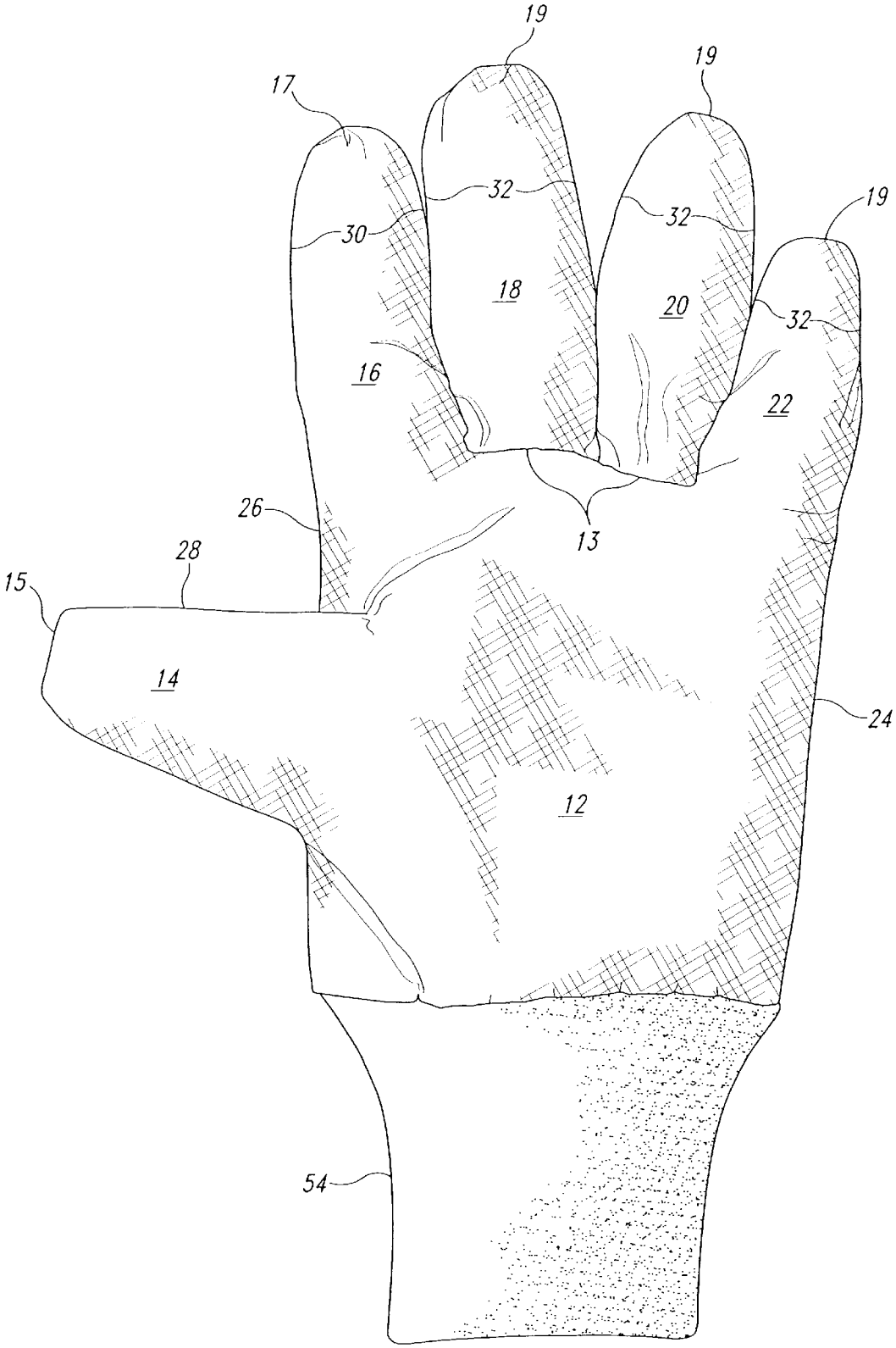
FIG. 3 is a plan view of a palmar side of a second embodiment of the inventive puncture-resistant glove. The figure illustrates a left-hand glove.

FIG. 3 illustrates a palmar side of a second embodiment of the puncture-resistant gloves. As in the first embodiment, the palmar portion of the second embodiment covers the entire palmar side of a hand, and includes a palm 12, a thumb 14, an index finger 16, a middle finger 18, a ring finger 20, and a little finger 22. The middle finger 18 and ring finger 20 are connected to palm 12 along seam 13, while the thumb 14, index finger 16 and little finger 22 are integrally attached to the palm 12 with the same piece of puncture resistant material. The palmar portion of the glove offers additional protection to the hand by wrapping around the sides of the hand, fingers and finger tips to the dorsal side of the glove. Thus, the palmar portion wraps around the lateral side 24 and contra-lateral side 26 of the hand, the sides 28 of the thumb, the sides 30 of the index finger, and the sides 32 of the middle finger 18, the ring finger 20 and the little finger 22. In addition, the palmar portion wraps around the tip 15 of the thumb, the tip 17 of the index finger, and the tips 19 of the middle, ring and little fingers. The palmar portion is made with the same puncture-resistant material as the palmar portion of the first embodiment.

Figure 4:
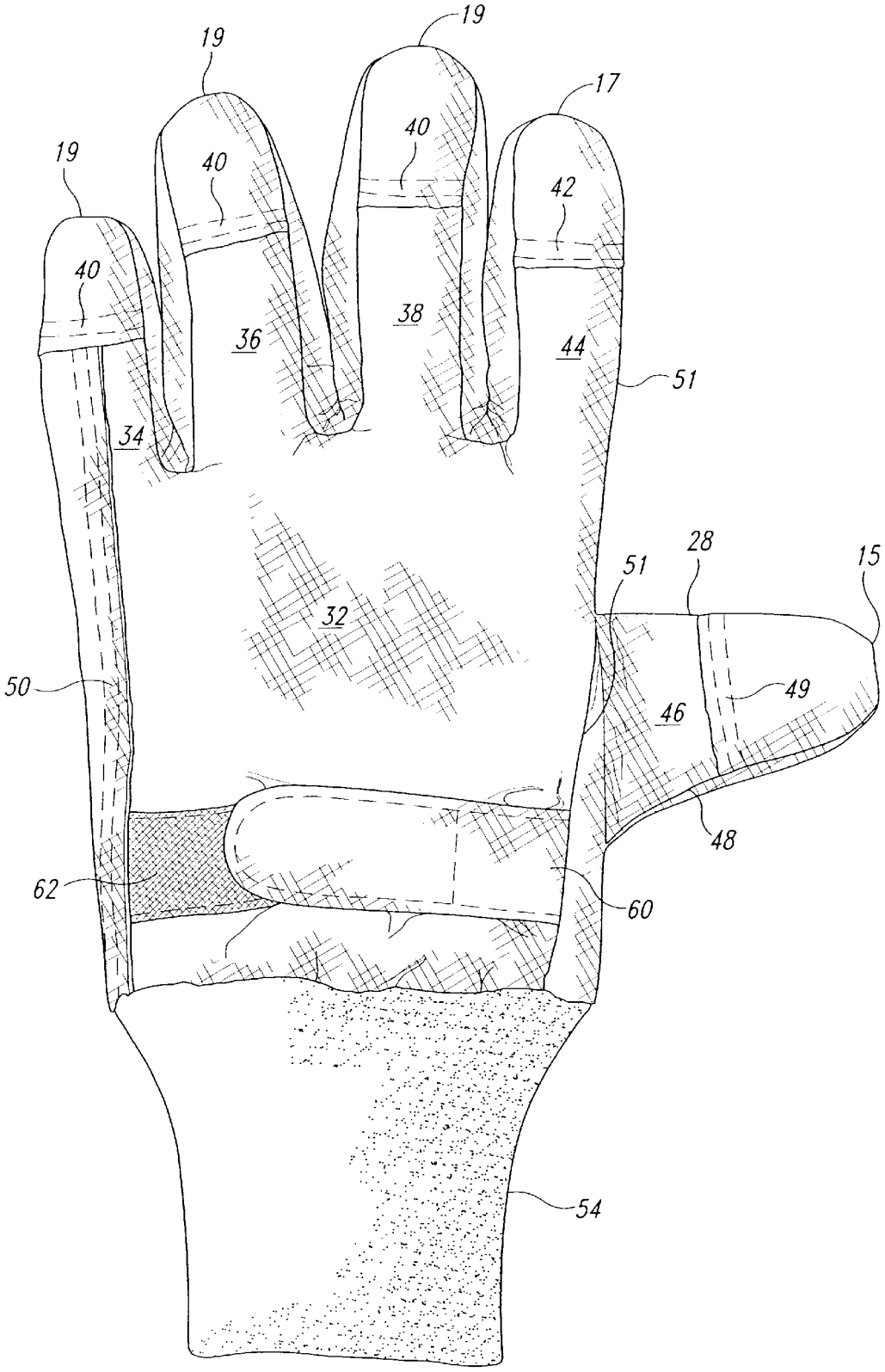
FIG. 4 is a plan view of a dorsal side of the second embodiment of the inventive puncture-resistant glove. The seams joining the puncture-resistant material to the stretchable material are shown. The figure illustrates a left-hand glove.

FIG. 4 illustrates the dorsal side of the second embodiment of the puncture-resistant glove. As with the first embodiment, the dorsal side of the glove 10 consists primarily of a dorsal portion 32 which includes a little finger portion 34, a ring finger portion 36, a middle finger portion 38, an index finger portion 44 and a separate thumb portion 46 sewn to the dorsal portion 32 along seam 51. The dorsal portion is sewn to the palmar portion along the finger tip seams 40, 42 and 49, the thumb seam 48, the lateral seam 50 and the contra-lateral seam 51, all of which are positioned on the dorsal side of the glove. At finger tip seams 40, 42 and 49, the palmar portions are wrapped around the fingertips 19, 17 and 15 and are sewn to the little finger portion 34, the ring finger portion 36, the middle finger portion 38, the index finger portion 44 and the thumb portion 46. The palmar portion also wraps around the lateral and contra-lateral sides of the hand and is sewn to the dorsal portion 32 along the lateral seam 50 and the contra-lateral seam 51. The palmar portion wraps around the side of the thumb 14 and is sewn to the dorsal portion along the thumb seam 48.

The primary difference between the dorsal side of the second embodiment and the dorsal side of the first embodiment is the material from which the dorsal side is made. In the first embodiment, the dorsal portion 32 is made of a stretchable material, which does not provide puncture protection; in the second embodiment the dorsal portion 32 is made of a puncture-resistant material. The second embodiment thus protects both the palmar and dorsal sides of the hand from puncture wounds. An additional feature of the second embodiment is the addition of a strap 60 across the dorsal side of the glove to permit the user to adjust the glove's fit. The strap serves the same function as the shirred elastic of the first embodiment. The strap is sewn onto the dorsal side of the glove along the contra-lateral seam 51. A first pad (not shown) of hook and eye material such as VELCRO® brand is sewn onto the strap at its free end, and a second pad 62 of hook and eye material, which receives the first pad, is sewn to the dorsal portion near the lateral seam 50. The user can adjust the fit of the glove by pulling on the strap until the glove is snug on the hand, and then the user fastens the first pad to the second pad 62. Applicant makes no claim to the trademark, VELCR0®.

The manufacture of the second embodiment is identical to the first embodiment, except for the addition of a step to sew the thumb portion 46 to the dorsal portion 32 along the contra-lateral seam 51 and a step to sew the strap 60 and second pad 62 to the dorsal portion.

Third Embodiment

Preferably, as described herein above, most seams on the glove are positioned on the dorsal side of the glove. Minimizing the number of seams on the palmar side of the glove increases the glove's puncture protection, because the seams are potential penetration points. Nonetheless, the present invention embraces glove embodiments wherein fewer than all of the seams connecting the palmer and dorsal portions are on the dorsal side of the glove.

Figure 5:
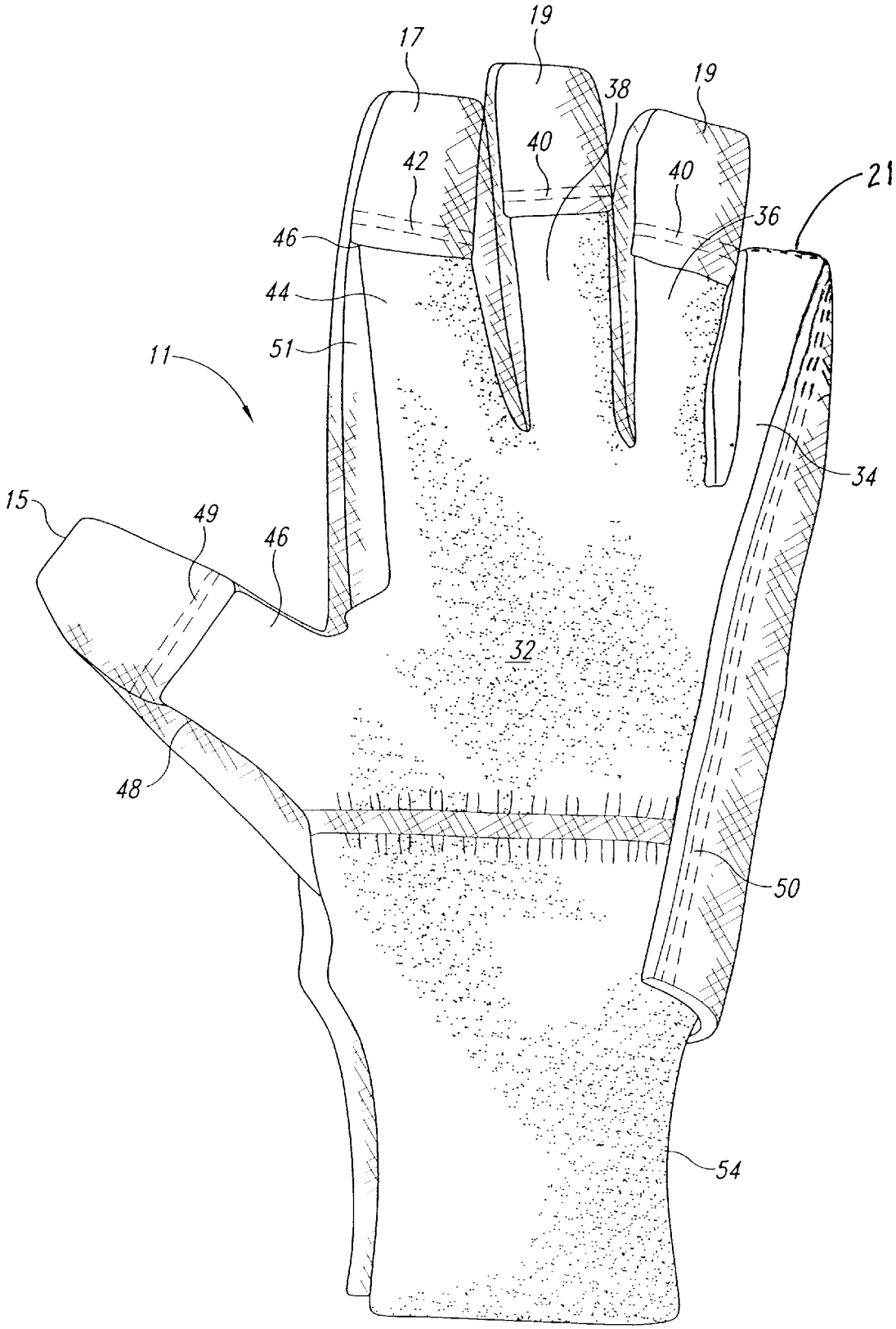
FIG. 5 is a plan view of the dorsal side of the third embodiment of the inventive puncture-resistant glove, wherein substantially all, but not all (here the seam at the tip of the little finger) seams joining the palmar and dorsal portions are located on the dorsal side of the glove. The figure shows seams and areas of puncture-resistant material (lighter shade) and stretchable elastic material (darker shade). The seams joining the puncture-resistant material to the stretchable material are shown. The figure illustrates a right-hand glove.

FIG. 5 illustrates the dorsal side 11 of a third embodiment of the puncture-resistant glove, wherein substantially all, but not all seams joining the palmar and dorsal portions are located on the dorsal side of the glove. The dorsal side 11 of the glove 10 consists primarily of a dorsal portion 32 that includes a little finger portion 34, a ring finger portion 36, a middle finger portion 38, an index finger portion 44 and a thumb portion 46. The dorsal portion is sewn to the palmar portion along finger tip seams 40, 42, 49 and 21, thumb seam 48, lateral seam 50 and contra-lateral seam 51, all of which, except for finger tip seam 21, are positioned on the dorsal side of the glove. At finger tip seams 40, 42 and 49, the palmar portions wrapped around the fingertips 19, 17 and 15 are sewn to the the ring finger portion 36, the middle finger portion 38, the index finger portion 44 and the thumb portion 46. At finger tip seam 21, the palmar portion does not wrap around the finger tip, but rather is sewn to the dorsal portion across the tip of the finger. The palmar portion also wraps around the lateral and contra-lateral sides of the hand and is sewn to the dorsal portion 32 along the lateral seam 50 and the contra-lateral seam 51. The palmar portion wraps around the side of the thumb 14 and is sewn to the dorsal portion along the thumb seam 48.

Dorsal portion 32 is provided with additional features that improve the fit of the glove. For example, a shirred elastic band can be sewn transversely into the dorsal portion 32 to provide a snug fit on the hand. In addition, an elastic knit wrist 54 is sewn to both the dorsal portion 32 and the palm 12, allowing the glove to fit properly on the wrist and hand of the user. The dorsal portion is preferably made using a one-way stretch material.

The steps in making this embodiment are essentially (except for wrapping of the little finger tip) those outlined herein above, using tools known in the art.

Fourth Embodiment (keystone-type thumb)

Figure 6:
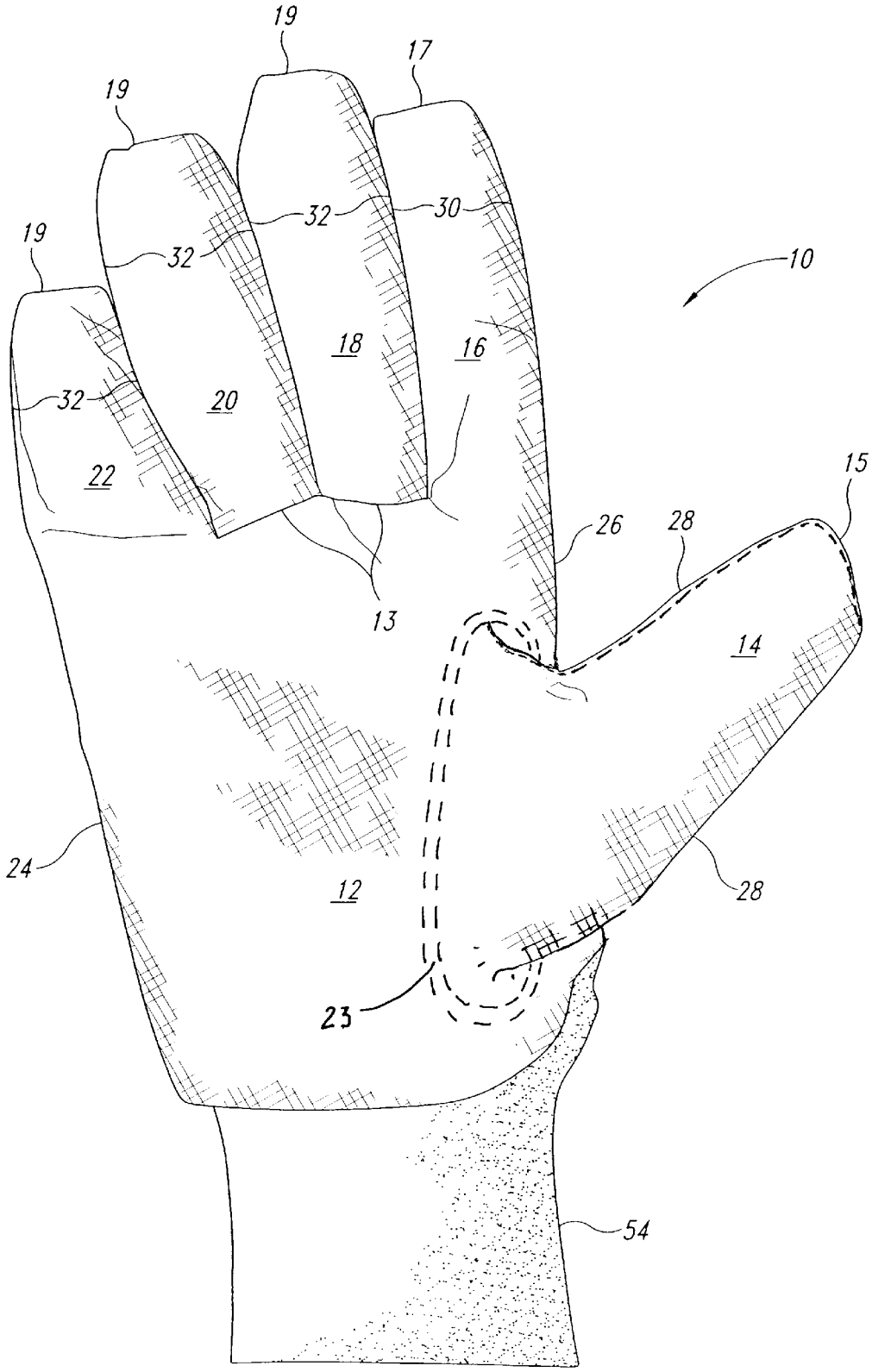
FIG. 6 is a plan view of the palmar side of the fourth embodiment of the inventive puncture-resistant glove. In this embodiment, the thumb is made of a separate thumb section of puncture-resistant material attached to the palmer portion with a keystone-type seam located on the palmer portion of the glove, whereby the keystone-type seam does not connect to the dorsal portion. The thumb and palmer portions overlap along the keystone seam to provide for maximum puncture resistance.

FIG. 6 illustrates a palmar side of a fourth embodiment of the puncture-resistant gloves. As in the first embodiment, the palmar portion of the second embodiment covers the entire palmar side of a hand, and includes a palm 12, a thumb 14, an index finger 16, a middle finger 18, a ring finger 20, and a little finger 22. The middle finger 18 and ring finger 20 are connected to palm 12 along seam 13, while index finger 16 and little finger 22 are integrally attached to the palm 12 with the same piece of puncture resistant material. In this embodiment, the thumb 14 is made of a separate thumb section of puncture-resistant material attached to the palmer portion with a keystone-type seam 23 located on the palmer portion of the glove, whereby the keystone-type seam does not connect to the dorsal portion. The thumb and palmer portions overlap along the keystone seam 23 to provide for maximum puncture resistance. The palmar portion of the glove offers additional protection to the hand by wrapping around the sides of the hand, fingers and finger tips to the dorsal side of the glove. Thus, the palmar portion wraps around the lateral side 24 and contra-lateral side 26 of the hand, the sides 30 of the index finger, and the sides 32 of the middle finger 18, the ring finger 20 and the little finger 22. In addition, the palmar portion wraps around the tip 17 of the index finger, and the tips 19 of the middle, ring and little fingers. The palmar 12 and thumb 14 portions are made with the same puncture-resistant material as the palmar portion of the first embodiment.

The manufacture of the fourth embodiment is identical to the first embodiment, except for sewing the thumb portion 14 to the palmer portion along the keystone-type seam 23, in place of wrapping the palmar portion around the side and top of the thumb and sewing it to the dorsal portion of the thumb.

Fifth Embodiment (glove liner)

Figure 7:
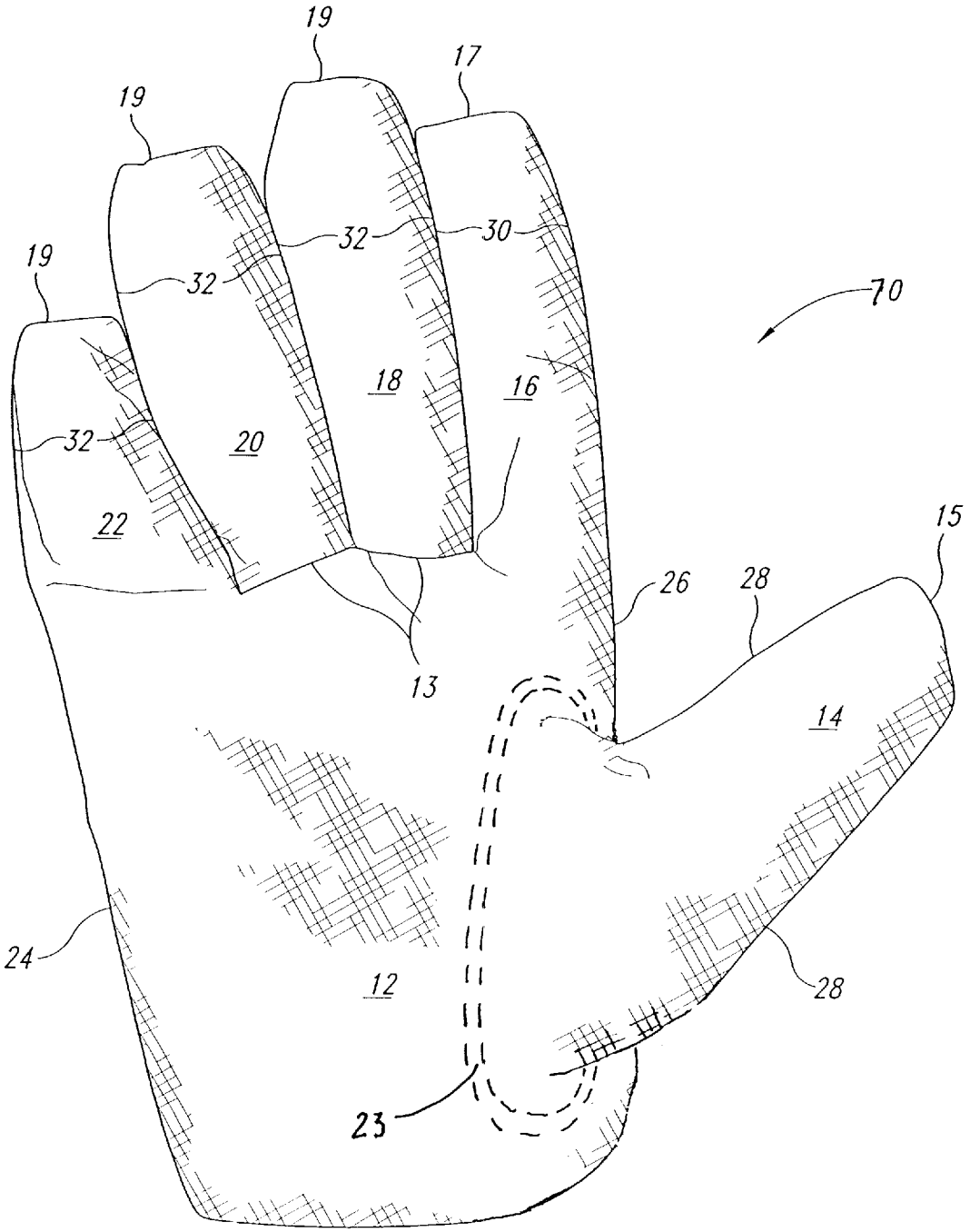
FIG. 7 is a plan view of the palmar side of the fifth embodiment of the present invention, a puncture-resistant glove liner. The glove liner is designed for use within a glove shell for protecting a hand from needles and sharp objects. In this embodiment the thumb, also of puncture-resistant material, is attached with a keystone-type seam located on the palmer side of the glove as in the case of the glove embodiment of FIG. 6.

FIG. 7 illustrates, as a fifth embodiment of the present invention, a palmar side of a puncture-resistant glove liner 70. The glove liner is designed for use within a glove shell for protecting a hand from needles and sharp objects. Like the puncture-resistant gloves of the present invention, the glove liner comprises: a puncture-resistant palmar portion designed to extend over the palmar side of the hand, a dorsal portion designed to extend over at least part of the dorsal side of the hand, the dorsal portion being sewn to the palmar portion, and a plurality of seams connecting the palmar portion to the dorsal portion, wherein at least one of the seams is located on the dorsal portion to provide for wrapping the palmer portion around to the seam on a dorsal side of the glove, and where the portions and seams conform to the interior contours and dimensions of the glove shell. Preferably, substantially all, or all of the connecting seams are located on the dorsal side of the liner. As in the case of gloves of the present invention, the dorsal portions may also be of puncture-resistant material.

As in the first and fourth embodiments, the palmar portion of the fifth embodiment covers the entire palmar side of a hand, and includes a palm 12, a thumb 14, an index finger 16, a middle finger 18, a ring finger 20, and a little finger 22. The middle finger 18 and ring finger 20 are connected to palm 12 along seam 13, while index finger 16 and little finger 22 are integrally attached to the palm 12 with the same piece of puncture resistant material. In this particular glove liner embodiment, like the fourth embodiment described above, the thumb 14 is made of a separate thumb section of puncture-resistant material attached to the palmer portion with a keystone-type seam 23 located on the palmer portion of the glove, whereby the keystone-type seam does not connect to the dorsal portion. The thumb and palmer portions overlap along the keystone seam 23 to provide for maximum puncture resistance. The palmar portion of the glove liner offers additional protection to the hand by wrapping around the sides of the hand, fingers and finger tips to the dorsal side of the glove liner. Thus, the palmar portion wraps around the lateral side 24 and contra-lateral side 26 of the hand, the sides 30 of the index finger, and the sides 32 of the middle finger 18, the ring finger 20 and the little finger 22. In addition, the palmar portion wraps around the tip 17 of the index finger, and the tips 19 of the middle, ring and little fingers. The palmar 12 and thumb 14 portions are made with the same puncture-resistant material as the palmar portion of the first and fourth embodiments.

Figure 8:
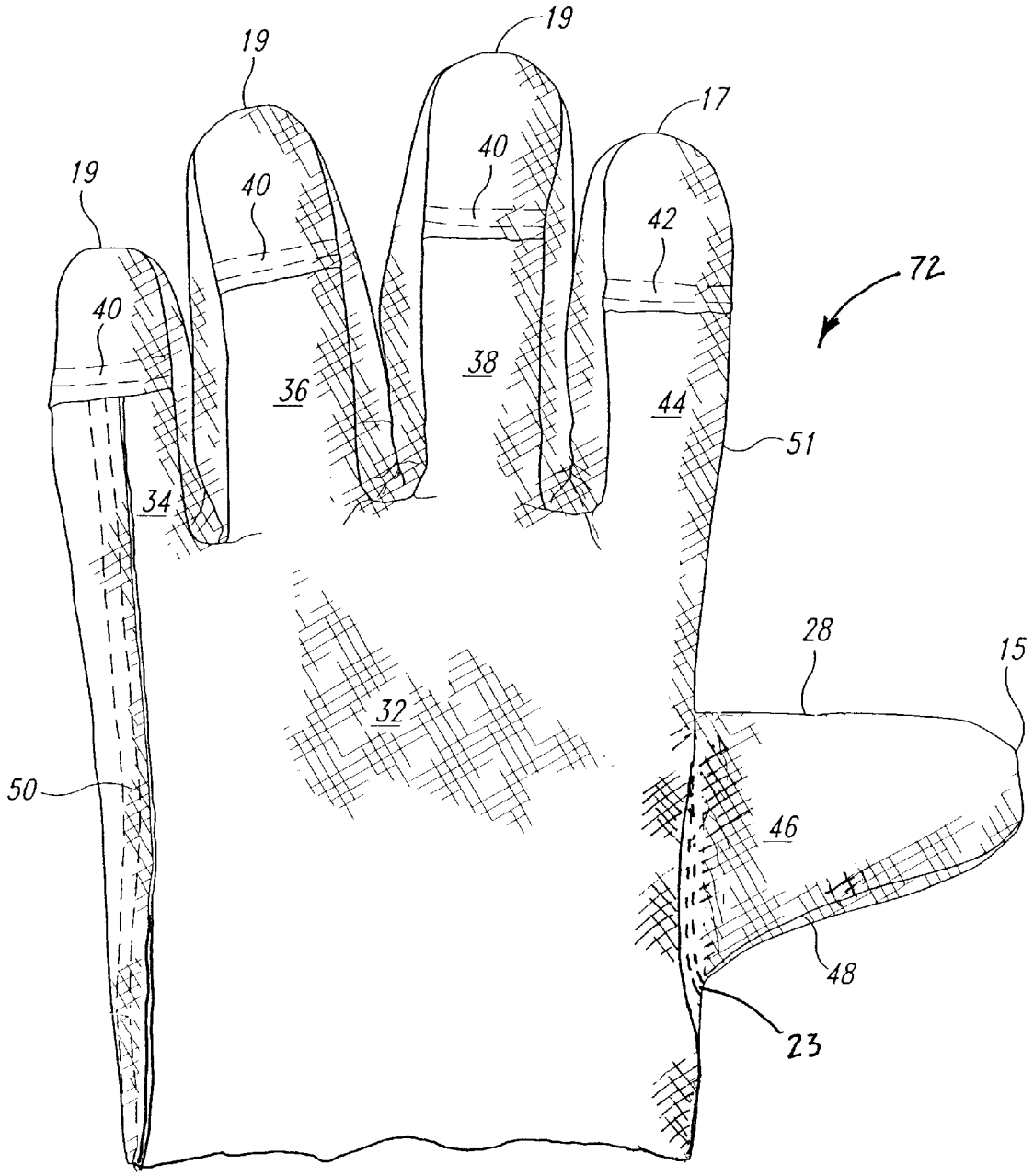
FIG. 8 is a plan view of the dorsal side of the puncture-resistant glove liner embodiment of FIG. 7. In this embodiment, shirred elastic (first embodiment), or hook and eye material strap and pad arrangements (second embodiment) are not used. Additionally, the elastic knit wrist, used in preferred glove embodiments, may be omitted, relying instead on a conformed fit within the glove shell for snugness.

FIG. 8 illustrates a dorsal side 72 of the puncture-resistant glove liner embodiment (i.e., the dorsal side of fifth embodiment). In this embodiment of the glove liner, shirred elastic (first embodiment), or strap and hook and eye material pad arrangement (second embodiment) are not used. Additionally. the elastic knit wrist, which, in the case of particular glove embodiments, is sewn to both the dorsal and palm portions (allowing the glove to fit properly on the wrist and hand of the user), may be omitted, relying instead on a conformed fit within the glove shell.

The manufacture of the fifth embodiment is identical to that described for the fourth embodiment (having a keystone-type thumb), except that the elastic knit wrist may be omitted for making the liner. The portions and seams of the glove liners of the present invention conform to the interior contours and dimensions of the glove shell, the liners being slightly smaller than the glove shell to provide for a snug fit.

Sixth Embodiment (dorsally-protective glove liner)

A sixth embodiment of the present invention is a glove liner designed for use within a glove shell for protecting the dorsal side of a hand from needles and sharp objects. Such an embodiment is useful, for example, in combination with glove shells, which comprise puncture-resistant material on their palmer sides only. The dorsally protective glove liner embodiment comprises a dorsal portion designed to extend over the dorsal side of the hand, the dorsal portion being made of puncture-resistant material, a palmar portion designed to extend over at least part of the palmar side of the hand, the palmer portion being sewn to the dorsal portion, and a plurality of seams connecting the dorsal portion to the palmer portion, wherein at least one of the seams is located on the palmer portion to provide for wrapping the dorsal portion around to the seam on a palmer side of the glove, and where the portions and seams conform to the interior contours and dimensions of the glove shell. Preferably, in this dorsally-protective embodiment, substantially all, or all of the seams connecting the dorsal portion to the palmer portion are located on the palmer side of the glove.

The manufacture of the sixth embodiment is identical to that described for the fifth embodiment (having a keystone-type thumb). As describe above, the portions and seams of the dorsally-protective glove liners of the present invention conform to the interior contours and dimensions of the glove shell, the liners being slightly smaller than the glove shell to provide for a snug fit.

Six embodiments of puncture-resistant gloves and glove liners have been described. A person skilled in the art, however, will recognize that many other embodiments are possible, including variations of the embodiments presented. For this reason, the scope of the invention is not to be determined from the description of the embodiment, but must instead be determined solely from the claims that follow.

What is claimed is:

1. A puncture-resistant glove for protecting a hand from needles and sharp objects, the hand having a palmar side and a dorsal side, and the glove comprising:

a palmar portion designed to extend over the palmer side of the hand, the palmar portion being made of a puncture-resistant material;

a dorsal portion designed to extend over at least part of the dorsal side of the hand, the dorsal portion being sewn to the palmar portion; and a plurality of seams connecting the palmar portion of the dorsal portion, wherein at least one of the seam is located on the dorsal portion to provide for wrapping the palmar portion around to the seam on a dorsal side of the glove.

2. The puncture-resistant glove of claim 1 wherein the plurality of seams comprises a lateral seam, a contra-lateral seam, a finger tip seam and a thumb seam.

3. The puncture-resistant glove of claim 2 wherein the thumb seam style is keystone.

4. The puncture-resistant glove of claim 2 wherein the seam located on the dorsal side of the glove is selected from the group consisting of a lateral seam, a contra-lateral seam, a finger tip seam and a thumb seam.

5. The puncture-resistant glove of claim 1 wherein the plurality of seams comprises a lateral scam, a contra-lateral scam, a thumb seam, and a finger tip seam, wherein the thumb seam is a keystone-type seam located on the palmar portion of the glove, and wherein the keystone-type seam does not connect to the dorsal portion.

6. The puncture-resistant glove of claim 1 wherein substantially all of the seams connecting the palmar portion to the dorsal portion are located on the dorsal side of the glove.

7. The puncture-resistant glove of claim 1 wherein the plurality of seams connecting the palmar portion to the dorsal portion are located on the dorsal side of the glove.

8. The puncture-resistant glove of claim 1 wherein the palmar portion wraps around a side of a palm, a side of the little finger, and a tip of each finger.

9. The puncture-resistant glove of claim 1 wherein the dorsal portion is made of a stretchable material.

10. The puncture-resistant glove of claim 9 wherein a shirred elastic band is sewn into the dorsal portion of the glove.

11. The puncture-resistant glove of claim 1 wherein the dorsal portion is made of a puncture-resistant material.

12. The puncture-resistant glove of claim 11 further comprising an adjustment strap positioned across the dorsal portion of the glove.

13. The puncture-resistant glove of claim 1 wherein the puncture-resistant material comprises a plurality of layers of a base fabric having a plurality of warp yarns densely interwoven with a plurality of fill yarns, the base fabric having a warp crimp, a fill crimp and a cover between adjacent warp yarns at the fill crossing of at least 100%.

14. The puncture-resistant glove of claim 13 wherein the warp crimp is greater than the fill crimp.

15. The puncture-resistant glove of claim 13 wherein the warp crimp is at least 10 times greater than the fill crimp.

16. The puncture-resistant glove of claim 13 wherein the fill crimp falls within the range of 1% to 2% and the warp crimp falls within the range of 20% to 30%.

17. The puncture-resistant glove of claim 13 wherein the base fabric has a cover between adjacent warp yarns at the fill crossing of at least about 130%.

18. The puncture-resistant glove of claim 13 wherein the yarns comprise at least one material selected from the group consisting of liquid crystal polyesters, para-aramids, and high-density polyethylenes.

19. The puncture-resistant glove of claim 13 wherein the densely interwoven base fabric has a density of at least 67 threads per inch in the warp or fill direction and having a cover between adjacent warp yarns at the fill crossing of at least 100%.

20. The puncture-resistant glove of claim 19 wherein substantially all of the seams connecting the palmar portion to the dorsal portion are located on the dorsal side of the glove.

21. The puncture-resistant glove of claim 1 further comprising an elastic knit wrist sewn to the palmar and dorsal portions of the glove at a wrist.

22. A puncture-resistant glove for protecting a hand from needles and sharp objects, the hand having a palmar side and a dorsal side, and the glove made by a process comprising:

cutting a pattern of a palmar portion of the glove from a puncture-resistant material, the palmar portion extending over the palmar side of the hand;

cutting a pattern of a dorsal portion of the glove, the dorsal portion extending over at least part of the dorsal side of the hand; and sewing the patterns of the palmar and dorsal portions together along a plurality of seams connecting the palmar portion to the dorsal portion, wherein at least one of the seams is located on the dorsal portion to provide for wrapping the palmer portion around to the seam on a dorsal side of the glove.

23. The puncture-resistant glove of claim 22 wherein sewing the patterns of the palmar and dorsal portions together comprises sewing the palmar and dorsal portions together along a lateral seam, a contra lateral seam, a finger tip seam and a thumb seam.

24. The puncture-resistant glove of claim 23 wherein the seam located on the dorsal side of the glove is selected from the group consisting of a lateral seam, a contra-lateral seam, a finger tip seam and a thumb seam.

25. The puncture-resistant glove of claim 23 wherein thumb scam style is keystone.

26. The puncture-resistant glove of claim 22 wherein Sewing the patterns of the palmar and dorsal portions together comprises sewing the palmar and dorsal portions together along a lateral seam, contra lateral scam, and a fingertip scam, wherein the thumb seam is a keystone-type seam located on the palmar portion of the, glove, and wherein the keystone-type seam does not connect to the dorsal portion.

27. The puncture-resistant glove of claim 22 wherein the plurality of seams connecting the palmar portion to the dorsal portion are located on the dorsal side of the glove.

28. The puncture-resistant glove of claim 21 wherein cutting the pattern of the palmar portion comprises cutting a pattern such that the palmar portion wraps around a side of the palm, a side of the little finger, and a tip of each finger.

29. The puncture-resistant glove of claim 22 made by a process further comprising sewing the finger tip portions of the palmar pattern to the dorsal side of the respective fingers of the pattern of the palmar portion.

30. The puncture-resistant glove of claim 22 wherein sewing the palmar portion and the dorsal portion together comprises sewing using a number 18 needle.

31. A pattern for a palmar portion of a puncture-resistant glove, the glove having a palmar side and a dorsal side, the pattern comprising:

a shaped sheet of puncture-resistant material, wherein a dimension of the sheet of material is designed such that the palmar portion of the glove will wrap around at least part of a hand and be sewn to a dorsal portion of the glove along seams located on the dorsal side of the glove.

32. The pattern of claim 31 wherein the dimension of the sheet of puncture-resistant material is designed so that the palmar portion of the glove will wrap around a side of a palm, a side of the little finger, and a tip of each remaining finger.

33. The pattern of claim 31 wherein the shaped sheet is designed for attachment of a keystone-type thumb, and wherein the thumb is of puncture-resistant material.

34. The pattern of claim 31 wherein the puncture-resistant material comprises a plurality of layers of a base fabric having a plurality of warp yams densely interwoven with a plurality of fill yams, the base fabric having a warp crimp, a fill crimp and a cover between adjacent warp yams at the fill crossing of at least 100%.

35. The pattern of claim 34 wherein the warp crimp is greater than the fill crimp.

36. The pattern of claim 34 wherein the base fabric has a cover between adjacent warp yarns at the fill crossing of at least about 130%.

37. The pattern of claim 34 wherein the yarns comprise at least one material selected from the group consisting of liquid crystal polyesters, para-aramides, and high-density polyethylenes.

38. The pattern of claim 34 wherein the densely interwoven base fabric has a density in excess of 80 threads per inch in the warp or fill direction, and having a cover between adjacent warp yams at the fill crossing of at least 100%.

39. A puncture-resistant glove liner, to be used within a glove shell for protecting a hand from needles and sharp objects, the hand having a palmar side and a dorsal side, and the glove liner comprising:

a palmar portion designed to extend over the palmar side of the hand, the palmar portion being made of a puncture-resistant material;

a dorsal portion designed to extend over at least part of the dorsal side of the hand, the dorsal portion being sewn to the palmar portion; and a plurality of seams connecting the palmar portion to the dorsal portion, wherein at least one of the seams is located on the dorsal portion to provide for wrapping the palmar portion around to the seam on a dorsal side of the glove, and where the portions and seams conform to the interior contours and dimensions of the glove shell.

40. The puncture-resistant glove liner of claim 39 wherein the plurality of seams comprises a lateral seam, a contra-lateral seam, a finger tip seam and a thumb seam.

41. The puncture-resistant glove liner of claim 40 wherein the thumb seam style is keystone.

42. The puncture-resistant glove liner of claim 39 wherein the plurality of seams comprises a lateral seam, a contra-lateral seam, and a finger tip seam, wherein the thumb seam is a keystone-type seam located on the palmer portion of the glove, and wherein the keystone-type seam does not connect to the dorsal portion.

43. The puncture-resistant glove liner of claim 39 wherein substantially all of the seams connecting the palmar portion to the dorsal portion are located on the dorsal side of the glove.

44. The puncture-resistant glove liner of claim 39 wherein the plurality of seams connecting the palmar portion to the dorsal portion are located on the dorsal side of the glove.

45. The puncture-resistant glove liner of claim 39 wherein the dorsal portion is made of a stretchable material.

46. The puncture-resistant glove liner of claim 39 wherein the dorsal portion is made of a puncture-resistant material.

47. The puncture-resistant glove liner of claim 39 wherein the puncture-resistant material comprises a plurality of layers of a base fabric having a plurality of warp yams densely interwoven with a plurality of fill yams, the base fabric having a warp crimp, a fill crimp, and a cover between adjacent warp yams at the fill crossing of at least 100%.

48. The puncture-resistant glove liner of claim 47 wherein the warp crimp is greater than the fill crimp.

49. The puncture-resistant glove liner of claim 47 wherein the fill crimp falls within the range of 1% to 2% and the warp crimp falls within the range of 20% to 30%.

50. The puncture-resistant glove liner of claim 47 wherein the base fabric has a cover between adjacent warp yarns at the fill crossing of at least about 130%.

51. The puncture-resistant glove liner of claim 47 wherein the yarns comprise at least one material selected from the group consisting of liquid crystal polyesters, para-aramids, and high-density polyethylenes.

52. The puncture-resistant glove liner of claim 47 wherein the densely interwoven base fabric has a density of at least 67 threads per inch in the warp or fill direction, and having a cover between adjacent warp yarns at the fill crossing of at least 100%.

53. The puncture-resistant glove liner of claim 47 further comprising an elastic knit wrist sewn to the palmar and dorsal portions of the glove liner at a wrist.

54. A puncture-resistant glove liner, to be used within a glove shell for protecting a hand from needles and sharp objects, the hand having a palmar side an a dorsal side, and the glove liner comprising:

a dorsal portion designed to extend over the dorsal side of the hand, the dorsal portion being made of puncture-resistant material;

a palmar portion designed to extend over at least part of the palmar side of the hand, the palmar portion being sewn to the dorsal portion; and a plurality of seams connecting the dorsal portion to the palmar portion wherein at least on of the seams is located on the palmar portion to provide for wrapping the dorsal portion around to the seam on a palmar side of the glove, and where the portions and scams conform to the interior contours and dimensions of the glove shell.

55. The puncture-resistant glove liner of claim 54 wherein the plurality of seams comprises a lateral seam, contra-lateral seam, a finger tip seam and a thumb seam.

56. The puncture-resistant glove liner of claim 54 wherein substantially all of the seams connecting the dorsal portion to the palmar portion are located on the palmar side of the glove.

57. The puncture-resistant glove liner of claim 54 wherein the plurality of seams connecting the dorsal portion to the palmar portion are located on the palmar side of the glove.

* * * * *

UNITED STATES PATENT AND TRADEMARK OFFICE

CERTIFICATE OF CORRECTION

PATENT NO. : 6,460,192 B2
DATED : October 8, 2002
INVENTOR(S) : Bruce R. Kindler It is certified that error appears in the above-identified patent and that said Letters Patent is hereby corrected as shown below:

Column 2,
Line 6, delete “yams”, insert -- yarns --

Column 3,
Lines 50, 55, 56 and 59, delete “yams”, insert -- yarns --

Column 6,
Line 45, delete “VELCR0”, insert -- VELCRO --

Column 9,
Line 46, delete “seam”, insert -- seams --
Lines 60 and 61, delete “scam”, insert -- seam --

Column 11,
Line 5, after “wherein” insert -- the --
Line 6, delete “scam”, insert -- seam --
Line 7, delete “Sewing”, insert -- sewing --
Lines 10 and 11, delete “scam”, insert -- seam --
Line 12, delete first instance “,”
Line 17, delete “21”, insert -- 22 --
Lines 51, 52 and 67, delete “yams”, insert -- yarns --

Column 12,
Lines 42, 43 and 45, delete “yams”, insert -- yarns --

Column 13,
Line 3, delete “an”, insert -- and --
Line 12, delete “on”, insert -- one --

UNITED STATES PATENT AND TRADEMARK OFFICE

CERTIFICATE OF CORRECTION

PATENT NO. : 6,460,192 B2
DATED : October 8, 2002
INVENTOR(S) : Bruce R. Kindler It is certified that error appears in the above-identified patent and that said Letters Patent is hereby corrected as shown below:

Column 14,
Line 1, delete “scams”, insert -- seams --

Signed and Sealed this

Tenth Day of August, 2004

JON W. DUDAS
*Acting Director of the United States Patent and Trademark Office*